US006170130B1

(12) United States Patent
Hamilton et al.

(10) Patent No.: US 6,170,130 B1
(45) Date of Patent: Jan. 9, 2001

(54) LASHING SYSTEM

(75) Inventors: Jeffrey R. Hamilton, Hoffman Estates; John S. Pontaoe, Chicago; Steven C. Keller, Island Lake, all of IL (US)

(73) Assignee: Illinois Tool Works Inc., Glenview, IL (US)

( * ) Notice: Under 35 U.S.C. 154(b), the term of this patent shall be extended for 0 days.

(21) Appl. No.: 09/232,493

(22) Filed: Jan. 15, 1999

(51) Int. Cl.[7] ..... A44B 21/00; A45F 5/00; B65D 63/00

(52) U.S. Cl. ..... 24/115 R; 24/129 R; 24/130; 24/300; 24/545; 224/257

(58) Field of Search ..... 24/115 R, 130, 24/122.6, 573.5, 300, 129 R, 129 A, 370, 545; 224/257, 258

(56) References Cited

U.S. PATENT DOCUMENTS

| | | | | |
|---|---|---|---|---|
| 42,895 | | 5/1864 | Woods . | |
| 0,479,509 | * | 7/1892 | Heaphy, Jr. | 24/370 |
| 483,299 | | 9/1892 | Cadwell . | |
| 1,047,295 | | 12/1912 | Riedl . | |
| 1,252,621 | * | 1/1918 | Smith | 24/129 R |
| 2,461,526 | | 2/1949 | Dull et al. . | |
| 2,884,674 | * | 5/1959 | Neuberger | 24/129 R |
| 3,100,324 | | 8/1963 | Tutino et al. . | |
| 3,426,400 | | 2/1969 | Lauro . | |
| 4,368,999 | | 1/1983 | Morel . | |
| 4,455,721 | | 6/1984 | Leibovitz . | |
| 4,768,689 | | 9/1988 | Davis . | |
| 5,197,166 | | 3/1993 | Meier et al. . | |
| 5,246,154 | | 9/1993 | Adams et al. . | |
| 5,308,337 | | 5/1994 | Bingisser . | |
| 5,425,485 | | 6/1995 | Carlo . | |
| 5,634,576 | | 6/1997 | Ardel . | |
| 5,784,762 | * | 7/1998 | Huntting | 24/545 |

* cited by examiner

*Primary Examiner*—Victor N. Sakran
(74) *Attorney, Agent, or Firm*—Schwartz & Weinrieb

(57) ABSTRACT

A lashing system having one or more cord anchors fastenable to a stationary member in spaced apart relation, and one or more cord clips each having a first portion with a first cord engaging member releasably and coupleable to a first cord portion and a second portion with a second cord engaging member selectively and releasably coupleable to a second cord portion so as to accommodate a particular article stowage application. The cord anchors also have a cord engaging member releasably coupleable to the cord, whereby the cord may be selectively coupled to one or more cord anchors, and thus positioned selectively on the stationary member. The lashing system also preferably includes a cord hook coupled to a first cord portion and a hook portion engagable by hooking to another cord portion.

23 Claims, 2 Drawing Sheets

LASHING SYSTEM

FIELD OF THE INVENTION

The present invention relates generally to lashing systems, and more particularly to lashing systems having stretchable elastic cords and tackle therefor.

BACKGROUND OF THE INVENTION

Lashing systems are known generally and are used widely for fastening articles to other members. It is known, for example, to fasten a net or an elastic cord to several fixed points on an outer portion of a backpack so as to form a web, which may be stretchable, between which articles are bundled or stowed. In the known prior art lashing systems, however, several points of the net or elastic cord are permanently fastened to the backpack so that the article capturing web formed thereby is relatively non-adjustably fixed thereon. The prior art lashing system thus generally imposes severe limitations on the number and size of articles stowable and on the stowage orientation thereof, due partly to the fixed web location and non-adjustability thereof.

The present invention is drawn toward advancements in the art of lashing systems and tackle therefor, useable for fastening articles to stationary members.

OBJECTS OF THE INVENTION

An object of the invention is to provide novel lashing systems and tackle therefor that overcome problems in the art, and that are economical.

A further object of the invention is to provide novel lashing systems and tackle therefor that are relatively and easily adjustable, and that accommodate a variety of article shapes and sizes, and stowage orientations.

Yet another object of the invention is to provide novel lashing systems and tackle therefor, and especially lashing systems having elastic cords useable for fastening articles to stationary members, including personal load carrying packs, luggage, seats, and vehicle beds, among other relatively stationary members.

A more particular object of the invention is to provide novel lashing systems generally comprising at least one and preferably a plurality of cord anchors fastenable to a stationary member in spaced apart relation, and one or more cord clips each having a first portion so as with a first cord engaging member releasably coupleable to a first cord portion and a second portion with a second cord engaging member conveniently and releasably coupleable to a second cord portion to accommodate a particular article stowage application. The cord anchors also have a cord engaging member releasably coupleable to the cord, whereby the cord may be selectively coupled to one or more cord anchors, and thus positioned selectively on the stationary member. The lashing system also preferably includes a cord hook coupled to a first cord portion, the cord hook having a hook portion coupleable to another cord portion by hooking thereto.

BRIEF DESCRIPTION OF THE DRAWINGS

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators throughout the several views, and wherein.

DETAILED DESCRIPTION OF THE INVENTION

Figure 1:
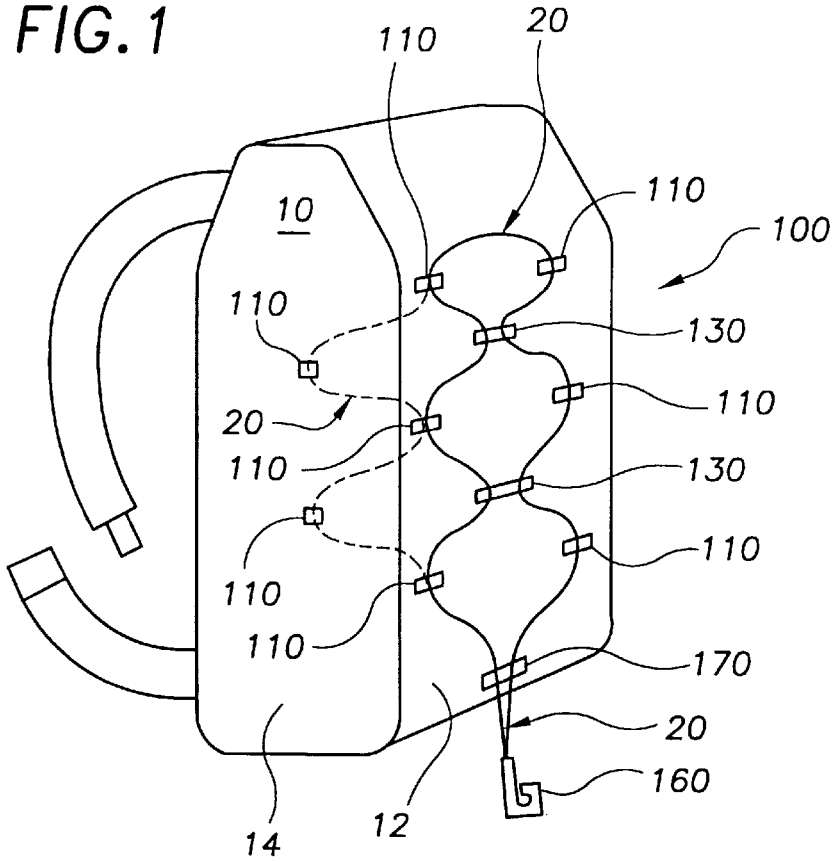
FIG. 1 is a perspective view showing a lashing system according to an exemplary embodiment of the invention.

FIG. 1 illustrates a lashing system 100 useable for fastening articles to a stationary member 10, which in the exemplary embodiment is a personal load carrying pack, for example, a backpack, knapsack, waistpack, fanny-pack, or other pack mountable on a human or animal torso. The stationary member 10 may be embodied more generally as luggage or as a hand bag. The stationary member 10 may also be embodied as a seat, for example the seat of a motorcycle or automobile or watercraft, or may be embodied as an automobile trunk space, or as a vehicle bed, for example the bed of a pick-up truck or non-motorized vehicle. Thus the term "stationary member" as used in the present specification and the claims thereof is to be interpreted broadly as being any one or more of the aforementioned embodiments.

FIG. 1 illustrates the lashing system 100 comprising generally a cord 20 releasably fastenable to the stationary member 10, and preferably a stretchable elastic cord having a first axial diameter when the cord is unstretched and a second axial diameter smaller than the first diameter when the cord is stretched. The cord may be by itself as in FIG. 1, or may be a portion of an elastic or inelastic web, or net, of the same or dissimilar material. The cord may, for example, be woven or fed through a perimeter portion of a net, or may itself be woven or sewn or otherwise fabricated to form a net. In other embodiments, the cord is relatively inelastic and non-stretchable.

The lashing system 100 also generally comprises at least one and preferably a plurality of at least two cord anchors 110 fastenable to the stationary member 10, preferably in spaced apart relation where more than one cord anchor is employed. FIG. 1 illustrates a plurality of cord anchors 110 fastened to corresponding portions of the stationary member 10, and in the exemplary embodiment the cord anchors are arranged in two generally spaced apart rows, or arrays, disposed on a back side portion 12 of the stationary member 10. One or more cord anchors 110 may also be disposed on other portions of the stationary member 10, for example on portions 14 thereof, as illustrated in FIG. 1. This configuration of the cord anchors 110 however is only exemplary and is not intended to be limiting.

The configurations, and more particularly the fastening location of the plurality of cord anchors 110 on the stationary member 10 are many, and depend to some extent on the type of stationary member 10 to which the one or more cord anchors 110 are fastened. According to the invention, the plurality of cord anchors 110 are located on at least one and preferably many surface portions of the stationary member 10 so as to provide many possible article stowing configurations for different articles as discussed below.

According to one aspect of the invention, the cord 20 is fastened to the stationary member 10 by the one or more cord anchors 110. More particularly, the cord 20 is coupled, and preferably releasably coupled, to the one or more cord anchors 110 by corresponding cord engaging members thereof. In the exemplary embodiment, there are a plurality of cord anchors 110 fastened to the stationary member 10, and the cord 20 may be selectively releasably coupled to any one or more of the cord anchors 110 so as to accommodate various stowable article sizes, shapes and numbers, or to stow an article in a particular location or orientation, depending on the particular requirements of the stowage application.

Figure 5:
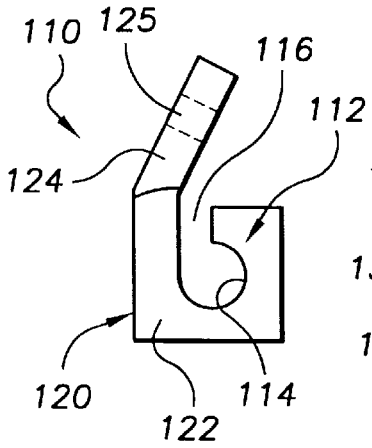
FIG. 5 is a side view of the exemplary cord anchor.
Figure 2:
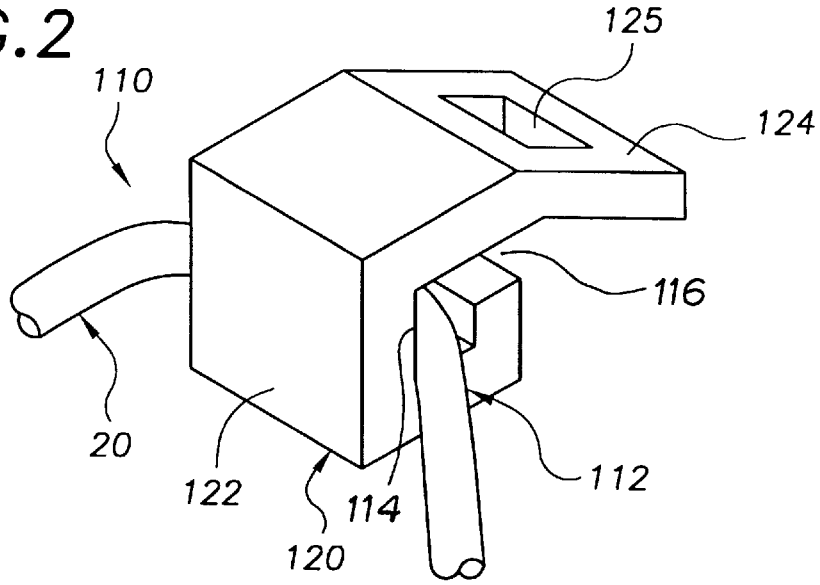
FIG. 2 is a perspective view of an exemplary cord anchor according to the invention.

FIGS. 2 and 5 illustrate the cord anchor 110 having a body member 120 with a cord engaging member 112 on a cord engaging portion 122 thereof, to which the cord 20 is coupled, preferably releasably as discussed further below. The cord engaging member 112 of each of the plurality of cord anchors 110 includes an opening 114 through the cord anchor 110 for receiving the cord 20. The opening 114 of cord anchor 110 preferably has an open end portion 116 so as to permit hooking engagement of the cord 20.

The opening 114 of the cord anchor 110 and the open end portion 116 thereof are sized to retain the cord 20, and to prevent separation of the cord 20 therefrom when the cord 20 is disposed through the opening 114, thereby preventing loss of the cord 20.

In some applications, it is desirable for the cord 20 to be freely movable axially through the opening 114 of the cord anchor 110, and thus a generally bore shaped diameter of the opening 114 is sized slightly larger than the diameter of the cord 20 for this purpose. In other words, the cord 20 is freely movable in either direction through the opening 114 of the cord anchor 110. The open end portion 116 of the opening 114 is generally a gap having an opening width sized less than the cord diameter so as to ensure secure retention of the cord 20 in the opening 114, and preferably at the same time permit releasable coupling of the cord 20 to the cord anchor 110.

In other alternative applications, it is desirable to frictionally clamp the cord 20 so as to prevent free axial movement of the cord 20 through the opening 114 of the cord anchor 110. In this alternative application, the generally bore shaped diameter of the opening 114 is somewhat less than the cord diameter so as to generate some friction therebetween. The generally bore shaped diameter of the opening 114 is sized relative to the cord diameter so as to obtain a desired degree of friction therebetween, and thus to control the ease with which the cord 20 is movable relative to the cord anchor 110. The open end portion 116 of the opening 114 is generally sized less than the cord diameter so as to ensure secure retention of the cord 20 in the opening 114, and preferably to permit releasable coupling of the cord to the cord 20 anchor 110, as discussed above.

In one embodiment, the cord anchor 110 is formed of acetal or polyethylene or some other plastic or composite material in a molding operation. The cord anchor may be formed alternatively of a metal material in a stamping or casting operation, or of some other material. Also, the cord anchor 110 may be formed so that it is more or less resilient. The cord anchor 110 may be a unitary member or an assembly.

Where the cord anchor 110 is more resilient, the cord 20 may be inserted through the open end portion 116 and into the opening 114 thereof by flexing the resilient cord anchor 110. In embodiments where the cord 20 is a stretchable elastic cord, the cord diameter may be reduced by stretching thus allowing insertion of the cord 20 into the opening 114, particularly in embodiments where the cord anchor 110 is less resilient. In embodiments where the cord anchor 110 is resilient and the cord 20 is a stretchable elastic, stretching the cord 20 or flexing the cord anchor 110 or a combination thereof facilitates insertion of the cord 20 into the opening of the cord anchor 110.

In one embodiment, the cord 20 is retained and preferably frictionally clamped by the opening 114 of the cord anchor 110 to which the cord 20 is fastened, thereby axially fixing the cord 20 relative to the cord anchor 110. Where the cord 20 is a stretchable elastic cord, the cord 20 is fastened to the cord anchor 110 by stretching and inserting the stretched cord 20 through the open end portion 116 and into the opening 114, as discussed above, and the cord 20 is clamped in the opening 114 of the cord anchor 110 upon unstretching the cord so that the diameter thereof is at the first relatively large diameter.

A stretchable cord 20 clamped by the cord anchor 110 is subsequently movable axially through the opening 114 of the cord anchor 110 by stretching the cord 20 to reduce its diameter smaller than its unstretched diameter at least to an extent that permits axial movement of the cord 20 through the opening 114, thereby permitting precise positional adjustment of where the cord is fastened to the cord anchor 110. The cord 20 whether stretchable or not may also be moved through the opening 114 of the cord anchor 110 by flexing the cord anchor 110 in a manner that unclamps the cord 20, for example by tugging sufficiently on the cord 20, or where the cord 20 is stretchable by stretching the cord 20, or by a combination thereof.

The cord anchor 110 also comprises an anchoring portion 124 fastenable to the stationary member 10. In FIGS. 2 and 5, the anchoring portion 124 includes a strap opening 125 therethrough for accommodating a fastening looped strap portion, not shown, but which may be sewn or riveted or otherwise fastened to the stationary member 10. Alternatively, the anchoring portion 124 may be a fabric portion insert molded in the cord engaging portion 122, whereby the fabric anchoring portion 124 itself is sewn or riveted directly to the stationary member 10. In other alternative embodiments, a plastic anchoring portion 124 of a unitary plastic anchor 110 is sewn or riveted directly to the stationary member 10.

Figure 6:
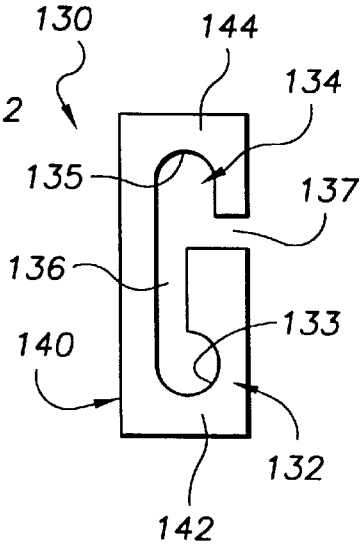
FIG. 6 is a side view of the exemplary cord clip.
Figure 3:
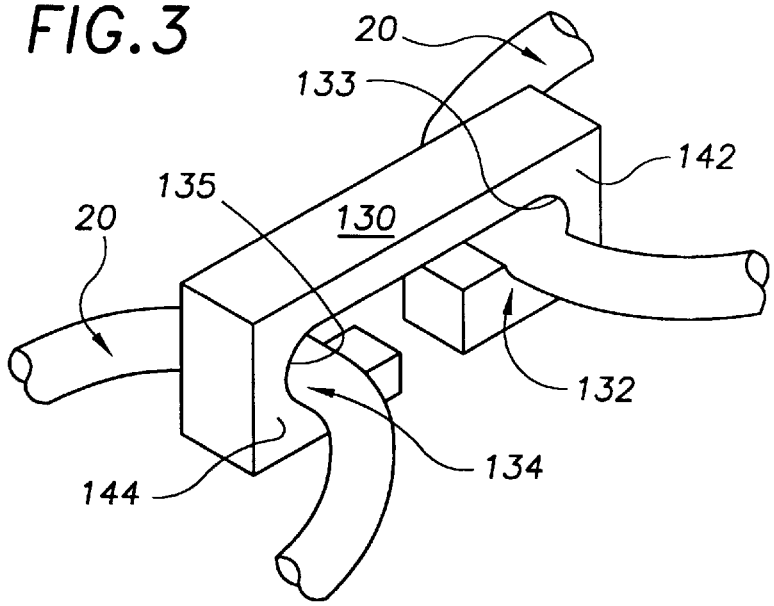
FIG. 3 is a perspective view of an exemplary cord clip according to the invention.
Figure 4:
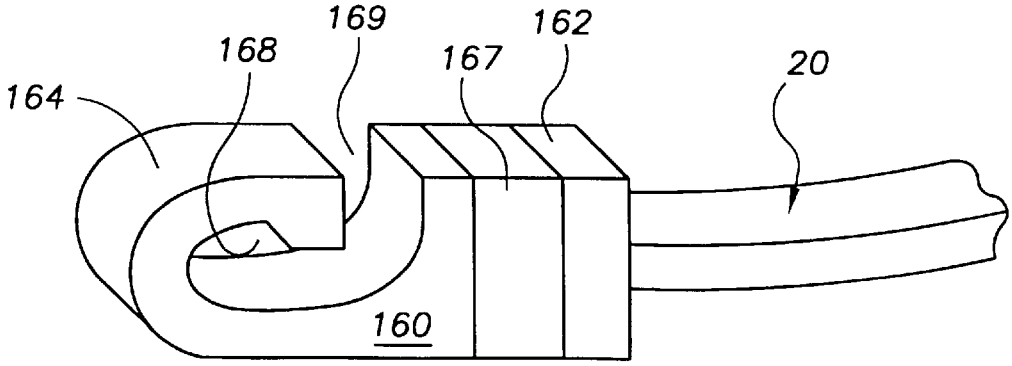
FIG. 4 is a perspective view of an exemplary cord hook according to the invention.

FIG. 1 illustrates the lashing system 100 further comprising generally one or more cord clips 130 fastenable to the cord 20. FIGS. 3 and 6 illustrate the cord clip 130 having a body member 140 with a first cord engaging member 132 on a first portion 142 thereof and a second cord engaging member 134 on a second portion thereof 144, to which portions of the cord 20 are coupled, preferably releasably as discussed further below. The first cord engaging member 132 of each of the plurality of cord clips 130 includes a first opening 133 through the cord clip 130 for receiving the cord 20. The first opening 133 of the cord clip 130 also preferably has a first open end portion 136 to permit hooking engagement of the cord 20.

The first opening 133 of the cord clip 130 and the first open end portion 136 thereof are sized to retain the cord 20, and to prevent separation of the cord 20 therefrom when the cord 20 is disposed through the first opening 133 thereof, thereby preventing loss of the cord 20.

In some applications, it is desirable for the cord 20 to be freely movable axially through the first opening 133 of the cord clip 130, and thus a generally bore shaped diameter of the first opening 133 is sized slightly larger than the diameter of the cord 20 for this purpose. In other words, the cord clip 130 is freely movable in either direction along the cord 20. The first open end portion 136 of the first opening 133 is generally a gap having a first opening width sized less than the cord diameter so as to ensure secure retention of the cord 20 in the first opening 133, and preferably at the same time to permit releasable coupling of the cord clip 130 to the cord 20. Thus configured, the first portion 142 of the cord clip 130 is securely fastenable to the cord 20 so that the cord clip 130 is freely movable axially along the cord 20 without substantial frictional engagement therebetween.

In other alternative applications, it is desirable to frictionally clamp the cord 20 so as to prevent free movement of the cord clip 130 axially along the cord 20. In this alternative application, the generally bore shaped diameter of the first opening 133 is somewhat less than the cord diameter so as to generate friction therebetween, and is sized relative to the cord diameter so as to obtain a desired degree of friction and thus to control the ease with which the cord clip 130 is movable relative to the cord 20. The first open end portion 136 of the first opening 133 is sized less than the cord diameter so as to ensure secure retention of the cord 20 in the first opening 133, and preferably to permit releasable coupling of the cord clip 130 to the cord 20 as discussed above. Thus configured, the first portion 142 of the cord clip 130 is securely fastenable to the cord 20 and is fixed axially relative thereto upon assembly therewith.

The second cord engaging member 134 of each of the plurality of cord clips 130 also includes a second opening 135 through the cord clip 130 for receiving the cord 20. The second opening 135 of cord clip 130 also preferably has a second open end portion 137 so as to permit hooking engagement of the cord 20. The second opening 135 of the cord clip 130 and the second open end portion thereof 137 are preferably sized so as to retain the cord 20, and to prevent separation of the cord 20 therefrom when the cord 20 is disposed through the second opening 135 thereof. In other embodiments the second open end portion 137 is not sized to retain the cord 20.

The second opening 135 of the cord clip 130 is preferably sized so as to permit hooking engagement of the cord 20 without clamping the cord 20, so that the second portion 144 of the cord clip 130 may be moved axially along the cord 20 without substantial frictional engagement therebetween, thereby permitting ready fastening and adjustment of the cord clip 130 to portions of the cord 20 so as to accommodate various article stowage objectives. In application, the second portion 144 of the one or more cord clips 130 may be selectively and removably fastened by hooking to the cord 20 so as to bundle or retain an article to the stationary member. Alternatively, the one or more cord clips 130 may be removably fastened by hooking to some other portion of the stationary member 10 besides the cord 20, for example to hooks or eyelets or other openings or other fastening points on the stationary member 10, thereby further increasing the flexibility and range of application of the lashing system 100.

In one embodiment, the cord clip 130 is a unitary member formed of a plastic, composite, metal or other material as discussed above in connection with the cord anchor 110. The cord clip 130 may also be formed so that it is more or less resilient. The cord clip 130 may be a unitary member or an assembly.

Where the cord clip 130 is more resilient, the cord 20 may be inserted into the first and second openings 133 and 135 thereof by flexing the resilient cord clip 130. In embodiments where the cord 20 is a stretchable elastic cord, the cord diameter may be reduced by stretching thus allowing insertion of the cord 20 into the first and second openings of the cord clip 130, particularly in embodiments where the cord clip 130 is less resilient. In embodiments where the cord clip 130 is resilient and the cord is a stretchable elastic, stretching the cord 20 or flexing the cord 20 clip 130 or a combination thereof facilitates insertion of the cord 20 into the first and second openings 133 and 135 of the cord clip 130.

In embodiments where the cord clip 130 is retained and frictionally clamped to an elastic stretchable cord 20 so as to axially fix the cord clip 130 thereto, the cord clip 130 may be fastened to the cord 20 by stretching the cord 20 and inserting the stretched cord 20 into the first opening 133, by means of the second and first open end portions 137 and 136. The cord 20 is then clamped in the first opening 133 of the cord clip 130 upon unstretching the cord so that the diameter thereof is at the first relatively large diameter. The clamped cord 20 is subsequently movable axially through the first opening 133 of the cord clip 130 by stretching the cord 20 so as to reduce its diameter smaller than its unstretched diameter at least to an extent that permits axial movement of the cord 20 therethrough. The cord 20 whether stretchable or not may also be moved through the first opening 133 of the cord clip 130 by flexing the cord clip 130 in a manner that unclamps the cord 20, for example by tugging sufficiently on the cord 20, or where the cord 20 is stretchable by stretching the cord, or by a combination thereof.

The lashing system 100 further comprises a cord hook 160 having a cord end fastening portion 162 and a hook portion 164, and a portion of the cord 20 fastened to the cord end fastening portion 162 thereof. Cord hooks are known generally and described more fully in U.S. Pat. No. 4,368,999 issued Jan. 18, 1983 entitled "Coupling or Connecting End Part For Flexible Elements Such as Cables, Wires or Other Elements" assigned commonly herewith and incorporated herein by reference.

Figure 7:
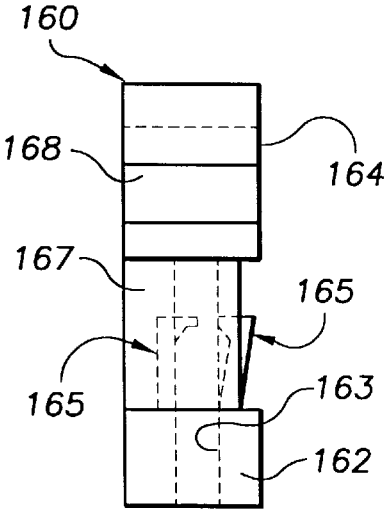
FIG. 7 is an end view of the exemplary cord hook.

FIG. 7 illustrates the cord fastening end portion 162 of the cord hook 160 having an opening 163 for accommodating one and preferably two free end portions of the cord 20. Resilient arm portions 165 disposed on opposing side portions of the cord hook 160 are flexible at least partially into the opening 163, and more particularly corresponding cord engagement members 166 thereof bite into one or more cord end portions disposed into the cord opening 163 so as to retain the cord portions therein, thereby securely fastening the cord 20 to the cord hook 160. FIG. 7 illustrates one of the resilient arms 165 maintained in the flexed cord retaining position by a clip portion 167 snap-fit or otherwise fastened about the cord hook 160. Alternatively, the one or more end portions of the cord 20 may be insert molded in the cord hook 160.

The hook portion 164 of the cord hook 160 includes an opening 168 therethrough for receiving the cord 20, and the opening 168 preferably has an open end portion 169 to permit hooking engagement of the cord 20. The opening 168 and open end portion thereof are preferably sized to permit hooking engagement, and in some embodiments releasable retention, of the cord 20 without clamping thereof, as discussed generally above in connection with the cord anchor 110 and cord clip 130, thereby permitting ready fastening and unfastening of the cord hook 160 to other portions of the cord 20 so as to accommodate particular article stowage objectives and to securely stow the cord 20 and cord hook 160 when no articles are secured thereby. The cord hook 160 may also be fastened to portions of the stationary member 10, other than the cord 20, as discussed above in connection with the second cord engaging member 134 of the cord clip 130.

The lashing system 100 may also include a cord lock 170 disposed about the cord 20, and more particularly about adjacent cord portions for fastening or drawing together the cord portions, thereby providing still further lashing system 100 adjustability for accommodating and stowing articles. Cord locks are known generally and described more fully in U.S. Pat. No. 5,197,166 issued Mar. 30, 1993 entitled "Cord Closure" assigned commonly herewith and incorporated herein by reference.

While the foregoing written description of the invention enables one of ordinary skill to make and use what is considered presently to be the best mode thereof, those of ordinary skill will understand and appreciate the existence of variations, combinations, and equivalents of the specific exemplary embodiments herein. The invention is therefore to be limited not by the exemplary embodiments herein, but by all embodiments within the scope and spirit of the appended claims.

What is claimed is:

1. A lashing system useable for fastening articles to a stationary member, comprising:

at least one pair of cord anchors fastenable to said stationary member at spaced apart locations upon said stationary member, wherein each cord anchor of said at least one pair of cord anchors has a cord engaging member for respectively slidably engaging first and second spaced apart intermediate portions of a cord; and a cord clip having a first end portion with a first cord engaging member having a first opening for slidable connection to a first end portion of said cord and a second end portion with a second cord engaging member having a second opening for slidable connection to a second end portion of said cord, such that said cord, said at least one pair of cord anchors, and said cord clip together define at least one adjustable, closed-loop cord lashing system upon said stationary member for securing articles within said at least one adjustable, closed-loop lashing system and with respect to said stationary member.

2. The lashing system of claim 1 further comprising a plurality of at least two cord anchors fastenable to the stationary member in spaced apart relation, each cord anchor having a cord engaging member, the cord releasably coupled to at least two cord engaging members of corresponding cord anchors.

3. The lashing system of claim 1, the first cord engaging member of the cord clip includes a first opening through the first portion of the cord clip for receiving the cord, the first opening of the cord clip having a first open end portion, the first opening of the cord clip and the first open end portion thereof sized to retain the cord in the first opening of the cord clip and to permit free movement of the cord clip in either direction along the cord.

4. The lashing system of claim 3, the second cord engaging member of the cord clip includes a second opening through the second portion of the cord clip for receiving the cord, the second opening of the cord clip having a second open end portion, the second opening of the cord clip and the second open end portion thereof sized to retain the cord in the second opening of the cord clip.

5. The lashing system of claim 1, the first cord engaging member of the cord clip includes a first opening through the first portion of the cord clip for receiving the cord, the first opening of the cord clip having a first open end portion, the first opening of the cord clip and the first open end portion thereof sized to retain the cord in the first opening of the cord clip and to frictionally clamp the cord to prevent free movement of the cord clip along the cord.

6. The lashing system of claim 5, the cord is a stretchable elastic cord having a first diameter when the cord is unstretched and a second diameter smaller than the first diameter when the cord is stretched, the first opening of the cord clip sized to permit the cord clip to move in either direction along the cord when the cord is stretched, and the opening of the cord clip sized to frictionally clamp the cord when the cord is unstretched.

7. The lashing system of claim 1, the cord engaging member of the cord anchor includes an opening through the cord anchor for receiving the cord, the opening of the cord anchor having an open end portion, the opening of the cord anchor and the open end portion thereof sized to retain the cord in the opening of the cord anchor and to permit free movement of the cord in either direction through the opening of the cord anchor.

8. The lashing system of claim 1, the cord engaging member of the cord anchor includes an opening through the cord anchor for receiving the cord, the opening of the cord anchor having an open end portion, the opening of the cord anchor and the open end portion thereof sized to retain the cord in the opening of the cord anchor and to frictionally clamp the cord to prevent free movement of the cord through the opening of the cord anchor.

9. The lashing system of claim 8, the cord is a stretchable elastic cord having a first diameter when the cord is unstretched and a second diameter smaller than the first diameter when the cord is stretched, the opening of the cord anchor sized to permit the cord to move axially through the opening of the cord anchor when the cord is stretched, and the opening of the cord anchor sized to frictionally clamp the cord when the cord is unstretched.

10. The lashing system of claim 1, the cord anchor having an anchoring portion fastenable to the stationary member.

11. The lashing system of claim 1 further comprising a cord hook having a cord end fastening portion, the cord hook having a hook portion, a portion of the cord fastened to the cord end fastening portion of the cord hook.

12. The lashing system of claim 1, the cord is a stretchable elastic cord having a first diameter when the cord is unstretched and a second diameter smaller than the first diameter when the cord is stretched, the cord is retained by the cord anchor and by the cord clip.

13. The lashing system of claim 1 further comprising a stationary member, the cord anchor fastened to the stationary member.

14. The lashing system of claim 13, the stationary member is a personal load carrying pack.

15. The lashing system as set forth in claim 1, wherein said cord clip further comprises:

a body member;

said first cord engaging member is defined within a first portion of said body member, and said second cord engaging member is defined within a second portion of said body member;

said first opening has an axis which extends through said first cord engaging member of said body member for axially accommodating said cord such that a longitudinal axis of said cord is disposed substantially coaxially with respect to said axis of said first opening when said cord is disposed within said first opening of said first cord engaging member of said body member, said first cord engaging member of said body member also having a first slot-type open end portion extending substantially radially with respect to said first opening and connected to said first opening so as to permit substantially radial insertion of said cord into said first opening;

said first slot-type open end portion of said first opening being sized so as to permit insertion of said cord therethrough and into said first opening, and to retain said cord within said first opening of said cord clip; and a second opening having an axis and extending through said second cord engaging member of said body member for axially accommodating said cord such that a longitudinal axis of said cord is disposed substantially coaxially with respect to said axis of said second opening of said second cord engaging member of said body member when said cord is disposed within said second opening of said second cord engaging member of said body member, said second cord engaging member of said body member having a second slot-type open end portion extending substantially radially with respect to said second opening and connected to said second opening, and to said first slot-type open end portion of said first opening, so as to selectively permit substantially radial insertion of said cord into one of said first and second openings.

16. The cord clip of claim 15, the second open end portion of the second opening sized to permit insertion of cord therethrough and into the second opening, and the second open end portion sized to retain the cord in the second opening of the cord clip.

17. The cord clip of claim 15 in combination with a cord, the cord is disposed and retained in the first opening of the cord clip, and first opening of the cord clip sized to permit the cord clip to move freely in either direction along the cord.

18. The cord clip of claim 15, the cord is disposed and retained in the first opening of the cord clip, the first opening of the cord clip sized to frictionally clamp the cord to prevent free movement of the cord clip along the cord.

19. The cord clip of claim 18, the cord is a stretchable elastic cord having a first diameter when the cord is unstretched and a second diameter smaller than the first diameter when the cord is stretched, the first opening of the cord clip sized to permit the cord clip to move in either direction along the cord when the cord is stretched, and the opening of the cord clip sized to frictionally clamp the cord when the cord is unstretched.

20. A cord anchor useable for retaining a cord of a backpack lashing system, comprising:

a body member;

a cord engaging portion defined upon a first portion of said body member;

an opening having an axis and extending through said cord engaging portion of said body member for axially accommodating a cord such that a longitudinal axis of said cord is disposed substantially coaxially with respect to said axis of said opening when said cord is disposed within said opening of said cord engaging portion of said body member, said cord engaging portion having a slot-type open end portion extending substantially radially with respect to said opening and connected to said opening so as to permit substantially radial insertion of said cord into said opening;

said open end portion of said cord engaging portion being sized so as to permit insertion of said cord therethrough and into said opening, said opening and said open end portion thereof being sized so as to retain said cord in said opening of said cord anchor; and an anchoring portion defined upon a second portion of said body member for securing said cord anchor to a support member, said anchoring portion having an aperture defined therein for accommodating a fastener for securing said anchoring portion and said cord anchor to a support member, wherein said aperture has an axis, along which the fastener is to be disposed, which is substantially perpendicular to said axis of said opening of said cord engaging portion of said body member.

21. The cord anchor of claim 20 in combination with a cord, the cord is disposed and retained in the opening of the cord anchor, and the opening of the cord anchor sized to permit the cord to move freely in either direction through the opening of the cord anchor.

22. The cord anchor of claim 20 in combination with a cord, the cord is disposed and retained in the opening of the cord anchor, the opening of the cord anchor sized to frictionally clamp the cord to prevent free movement of the cord through the opening of the cord anchor.

23. The cord anchor of claim 22, the cord is a stretchable elastic cord having a first diameter when the cord is unstretched and a second diameter smaller than the first diameter when the cord is stretched, the opening of the cord anchor sized to permit the cord to move axially through the opening of the cord anchor when the cord is stretched, and the opening of the cord anchor sized to frictionally clamp the cord when the cord is unstretched.

* * * * *